US005813623A

United States Patent [19]

Hutzenlaub et al.

[11] Patent Number: 5,813,623

[45] Date of Patent: Sep. 29, 1998

[54] DEVICE FOR APPLYING A MATERIAL STRIP TO A WINDING TUBE

[75] Inventors: Armin Hutzenlaub; Dieter Düppengiesser, both of Wiehl, Germany

[73] Assignee: Kampf GmbH & Co. Maschinenfabrik, Wiehl, Germany

[21] Appl. No.: 894,310

[22] PCT Filed: Jan. 26, 1996

[86] PCT No.: PCT/EP96/00317

§ 371 Date: Jul. 28, 1997

§ 102(e) Date: Jul. 28, 1997

[87] PCT Pub. No.: WO96/23720

PCT Pub. Date: Aug. 8, 1996

[30] Foreign Application Priority Data

Jan. 30, 1995 [DE] Germany ..... 195 02 769.8

[51] Int. Cl.[6] ..... B65H 35/04; B65H 18/08

[52] U.S. Cl. ..... 242/527.4; 242/523.1; 242/533.4

[58] Field of Search ..... 242/527.4, 532.7, 242/533.2, 533.4, 533.6

[56] References Cited

U.S. PATENT DOCUMENTS

| | | | |
|---|---|---|---|
| 3,482,793 | 12/1969 | Mainstone . | |
| 3,501,104 | 3/1970 | Hellemans | 242/527.4 |
| 3,782,650 | 1/1974 | Donnell, Jr. | 242/523.1 |
| 3,908,924 | 9/1975 | Schulze . | |
| 4,058,267 | 11/1977 | Schuttler | 242/527.4 |
| 4,171,780 | 10/1979 | Bugnone | 242/533.4 |
| 4,678,133 | 7/1987 | Suzuki . | |

FOREIGN PATENT DOCUMENTS

| | | |
|---|---|---|
| 0 699 610 A1 | 3/1996 | European Pat. Off. . |
| 1252503 | 10/1967 | Germany . |
| 287926 | 3/1991 | Germany . |
| 757475 | 9/1956 | United Kingdom . |

*Primary Examiner*—John P. Darling
*Attorney, Agent, or Firm*—Herbert Dubno; Andrew Wilford

[57] ABSTRACT

An apparatus for winding a web on a sleeve has a pair of winding shafts adapted to hold respective such sleeves and each pivotal into a winding position coaxial with a winding axis and into a takeoff position spaced therefrom. A contact roller around which the web passes presses the web radially toward the winding axis so that when a sleeve is in the winding position the contact roller presses the web against it. A cutter can sever the web when same extends from the contact roller to the takeoff position between the contact roller and the takeoff position and thereby produces a leading web end extending from between the contact roller and a sleeve in the winding position. An applying device includes an applicator rod pivotal about the winding axis and extending a full working width of the machine, pressure elements extending from the connecting rod and having free ends, and respective rollers on the free ends engageable with the web for pressing the leading end against the sleeve in the winding position after severing of the web.

6 Claims, 3 Drawing Sheets

DEVICE FOR APPLYING A MATERIAL STRIP TO A WINDING TUBE

CROSS REFERENCE TO RELATED APPLICATIONS

This application is the US national phase of PCT application PCT/EP96/00371 filed 26 January 1996 with a claim to the priority of German application 195, 92 969.8 itself filed 30 January 1995.

FIELD OF THE INVENTION

The invention relates to an apparatus for applying webs, in particular highly sensitive plastic foils, in a winding machine, preferably a multiple winding machine, with a winding shaft pivotal into the winding position for holding winding sleeves, a cooperating contact roller, a transverse cutting system for transversely slitting the web, and an applicator system for wrapping and applying the incoming web in the region of the winding sleeves.

BACKGROUND OF THE INVENTION

In order surely to apply a new leading web end to an empty winding sleeve it is standard practice to apply a strip of glue or adhesive to the empty winding sleeve. This requires a separate operational step and furthermore with thin highly sensitive goods several layers of the web are ruined. Such unusable winding sleeves can be reused only with great difficulty as it is expensive to separate the cardboard, glue, and plastic from one another.

The present invention is based on the idea of wholly dispensing with glue or adhesive in applying a new leading web end of a web to be wound up.

OBJECT OF THE INVENTION

It is an thus an object of the invention to provide an apparatus of the above-described type by means of which the leading end of a stationary web slit transversely of its feed direction, preferably of a highly sensitive plastic foil, can be accurately laid without overlap or folds on an empty winding sleeve without the use of an adhesive.

SUMMARY OF THE INVENTION

This object is attained in that the applicator system has an applicator element pivotal about the longitudinal axis of the winding shaft for pressing the leading web end against the winding sleeves. With the means according to the invention even with very sensitive webs, such as for example the highly sensitive plastic foils used in photography, without the use of an adhesive a sure and perfect application of the leading web end on the winding sleeve is ensured.

In addition the applicator element has a connecting rod pivotal about the axis of the winding shaft, extending over the working width of the machine, and carrying spring-like pressure elements whose free ends preferably carry rotatable pressure rollers or the like. The pressure elements preferably formed as tongues or as springy holding plates are formed as support elements for the more or less closely juxtaposed pressure rollers or the like. By means of such construction of the pressure elements one obtains an applicator system that is independent of format since the pressure rollers are so close to each other that on a change in cut width no adjustment of the applicator system is necessary.

It is important to the invention that a pivoting mechanism is arranged on the ends of the connecting rod. The pivoting mechanism serving for centering and guiding has a slotted first ring disk connected via a lever with the connecting rod and a concentrically arranged slotted second ring disk pivotal relative to the first ring disk, the common disk centers coinciding in the applying position of the applicator system with the longitudinal axis of the winding shaft.

To drive the pivotal ring disk of the pivoting mechanism at least two spaced gears are provided meshing with a toothing on the periphery of the rotatable ring disk or with an intermediate disk fixed thereto and of which during the pivotal movement at least one is always in mesh with the toothing of the rotatable ring disk or of the intermediate disk. This ensures that in the case when one of the gears is in the region of the slot of the rotatable disk, the other gear remains in driving mesh so as to guarantee a constant and uninterrupted pivoting of the applicator system.

In addition the applicator system is preferably constructed such that on pivoting in of the applicator system shortly before transversely cutting the web by means of the pressure elements or the pressure rollers, the web is pressed with light pressure against the winding sleeve. In addition after transversely cutting the web the length of the remaining piece of web between the starting applicator position of the applicator rollers and a cutting blade of the transverse cutting system corresponds generally to the remaining circumference of the winding sleeve between the initial contact point of the pressure roller against the winding sleeve and the contact position between the contact roller and the winding sleeve.

Finally the pivotal movement of the applicator system is limited such that the pressure rollers come to a stop directly before the contact location between the contact roller and the winding sleeve.

The applicator system according to the invention is very easily adapted to different sleeve diameters. To this end the connecting rod need only be pivoted about its axis. In this manner the rollers on the spring tongues or holding plates change their radius relative to the imaginary rotation axis.

BRIEF DESCRIPTION OF THE DRAWING

A preferred embodiment of the invention is shown in the drawing and is described more closely in the following. Therein.

SPECIFIC DESCRIPTION

Figure 1:
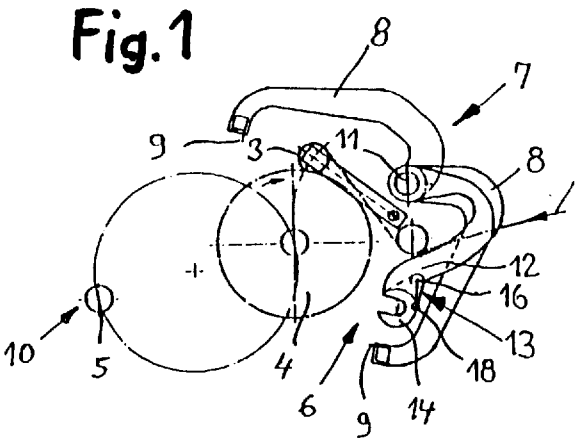
FIGS. 1 through 6 show in a schematic representation the applying method of a new web leading end according to the invention.

FIGS. 1 through 6 show in a schematic side view a multiple winding machine with devices for transversely slitting and applying the web 1, preferably a highly sensitive plastic foil. The web 1 is guided around a deflecting roller 2 and a contact roller 3 and then as is known the web is wound up on a winding roller 4. Diametrally opposite the winding roller 4 a winding shaft 10 extending the full machine width can be fitted with winding sleeves 5 during the winding operation.

The winding shaft 10 can as described below be swung by rotation of a changing cross of the multiple winding machine into the position of the current winding roller 4. The multiple winding machine of interest here further has an applicator system 6 as well as a transverse cutter 7 for the web. The transverse-cutting system 7 has two pincher-like openable and closable support arms 8 whose free ends carry cutting blades 9. Both support arms are pivotal about a common axis 11. In the illustrated embodiment an arm 12 of the applicator system 6 is also pivotal about this axis 11. On or near its free end the support arm 12 has an applicator element 13 and a pivoting mechanism 14 which are both more closely described below.

Figure 7:
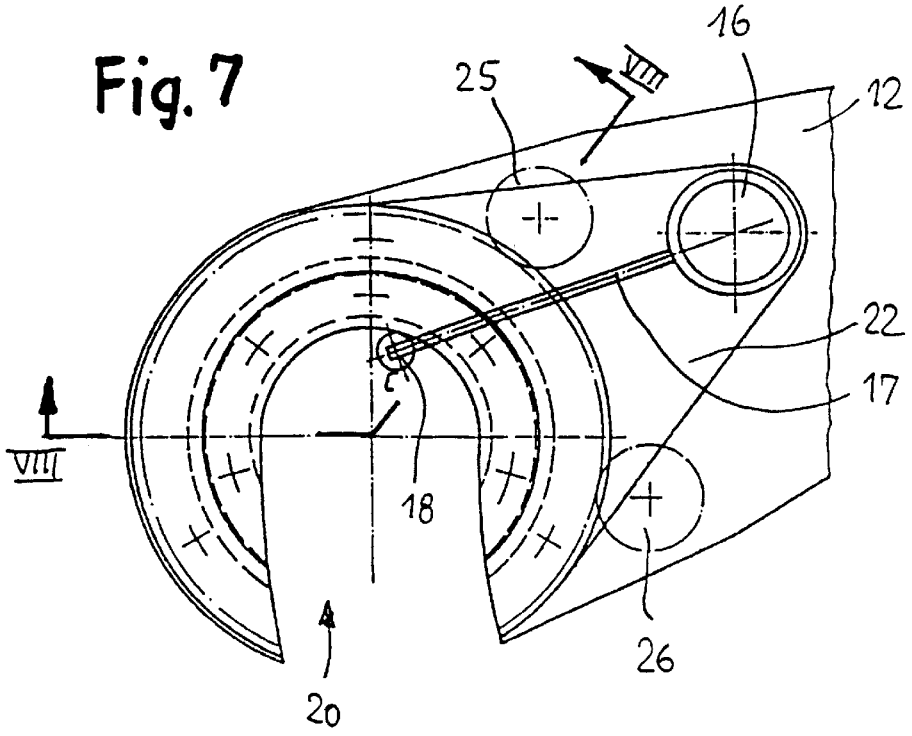
FIG. 7 is a part of the applicator system in enlarged scale.
Figure 8:
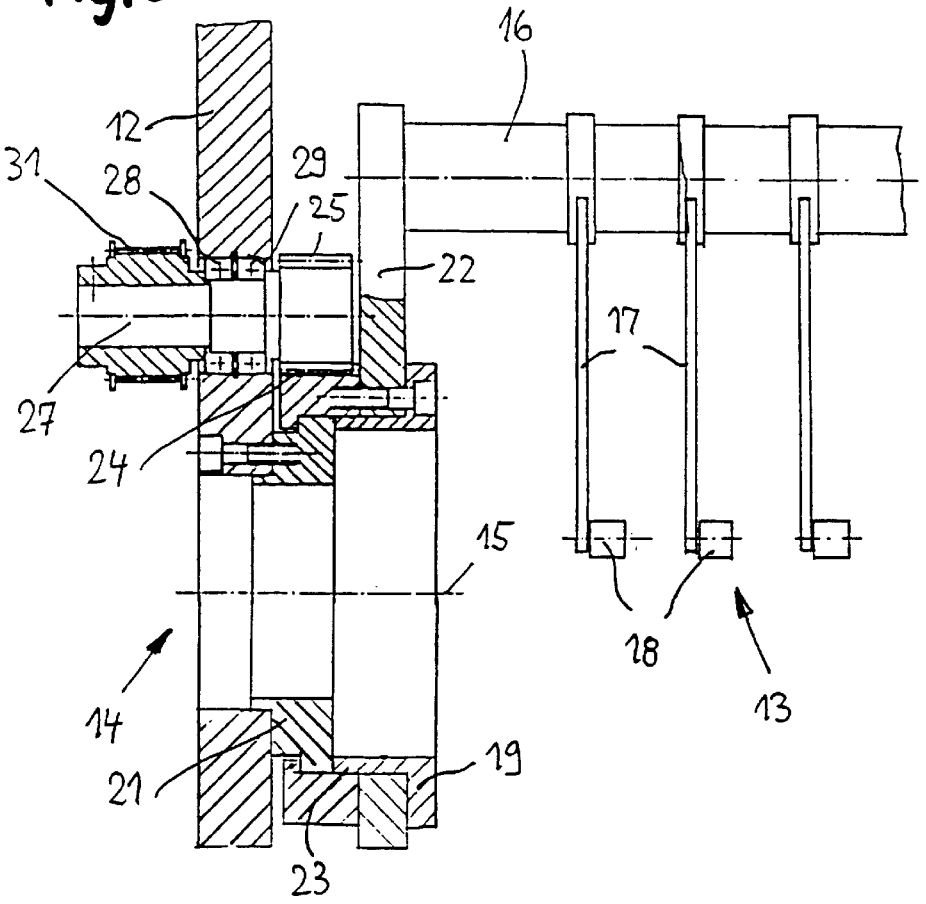
FIG. 8 is a section taken along line VIII—VIII of FIG. 7.

A preferred embodiment of an applicator element 13 as well as a pivoting mechanism 14 are shown in FIGS. 7 and 8. The applicator element 13 has a connecting rod 16 which is pivotal about the axis 15 of the winding shaft 10, which extends over the entire working width of the winding machine, and from which spring-like pusher elements 17 formed as spring holder plates or tongues project. The front ends of the tongues 17 carry rotatable pressure rollers 18 which as described below engage the web 1 and apply a new web leading end to the winding sleeve 5.

The above-described pivoting mechanism 14 is mounted on each end of the connecting rod 16. This pivoting mechanism comprises two generally C-shaped ring disks 19 and 21 each formed with a slot 20 and of which the first ring disk 19 is connected via a lever 22 with the connecting rod 16 while the other ring disk 21 is fixed on the support arm 12 of the applicator system 6. The ring disk 19 is rotatable relative to the ring disk 21 that is fixed on the support arm 12. To this end the ring disk 19 is mounted on an intermediate ring 23 which has an external toothing 24 in mesh with two gears 25 and 26. The gears 25 and 26 each have a stub shaft 27 that is mounted rotatably by a bearing 28 in a bore 29 of the support arm 12. Respective drive gears 31 for the gears 25 and 26 are on the opposite side of the support arm 12 on the stub shafts 27 to ensure via an unillustrated toothed belt or the like and an also unillustrated connecting shaft synchronous driving of the two rotatable ring disks 19. The spacing between the gears 25 and 26 is such that the pivoting drive of the ring disk 19 by one of the gears 25 or 26 is maintained when the other gear is in the region of the slot 20 of the ring disk.

Figure 2:
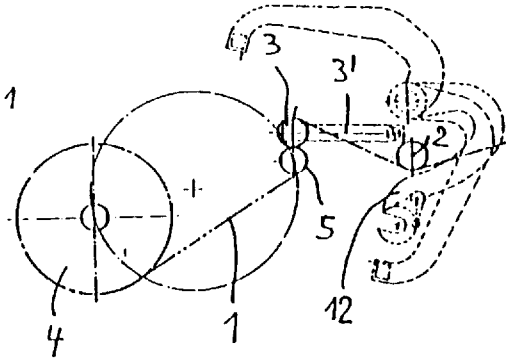
Figure 3:
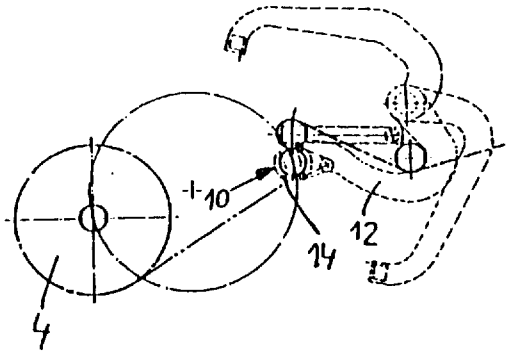

The apparatus for cutting and applying a web according to the invention functions as follows:

Starting from the FIG. 1 position, as soon as the winding roller 4 has attained its desired diameter it is swung into the FIG. 2 position. During this movement the previously readied winding shaft 10 with the winding sleeve 5 carried on it is also moved into the FIG. 2 position. The web 1 thus extends from the winding sleeve 5 to the winding roller 4. Beforehand the contact roller 3 is pivoted by its arm 3' against the winding sleeve 5 so that the web is perfectly guided and clamped between same. As visible in FIG. 3 the support arm 12 now shown in dashed lines is swung so far up that the pivoting mechanism 14 can engage around the winding shaft 10 from below outside the actual working width so that the web as before extends from the winding sleeve sitting on the winding axis to the winding roller 4. In this position the pressure rollers 18 engage under light pressure on the web engaged around the winding sleeve as better shown in FIG. 9.

Figure 4:
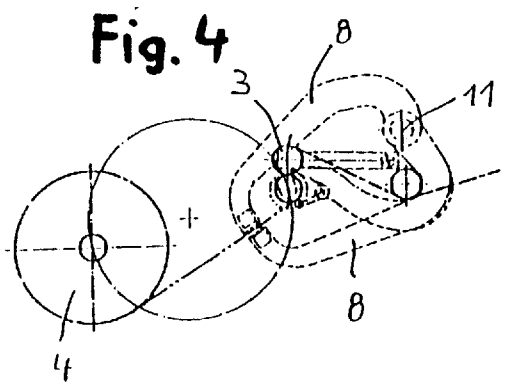
Figure 5:
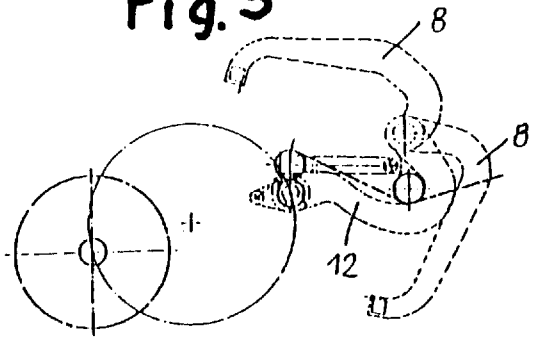
Figure 6:
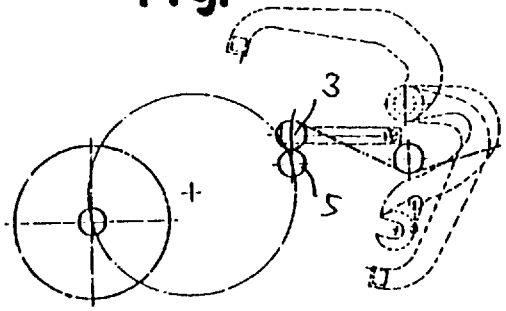
Figure 10:
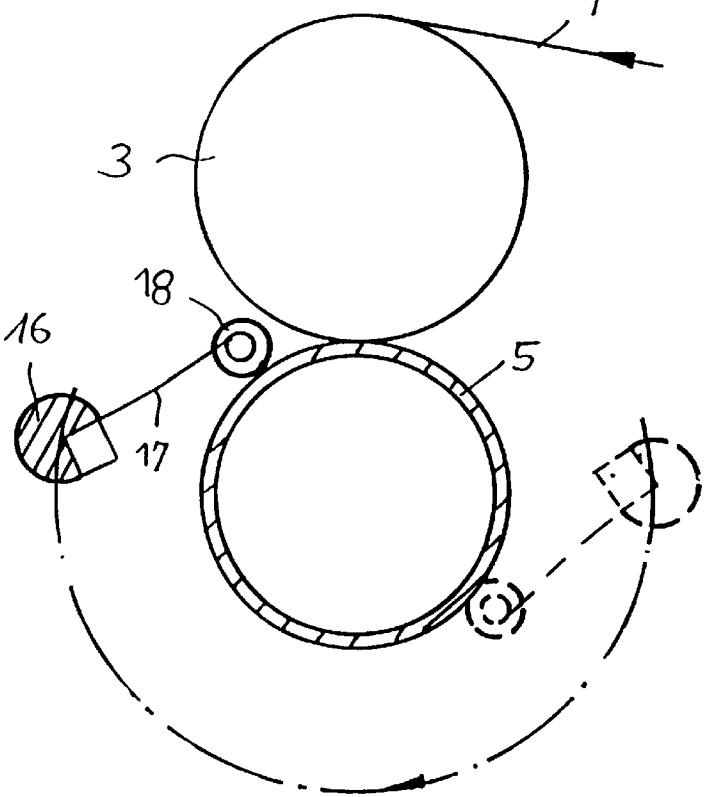
FIG. 10 is the end of the applying method.
Figure 9:
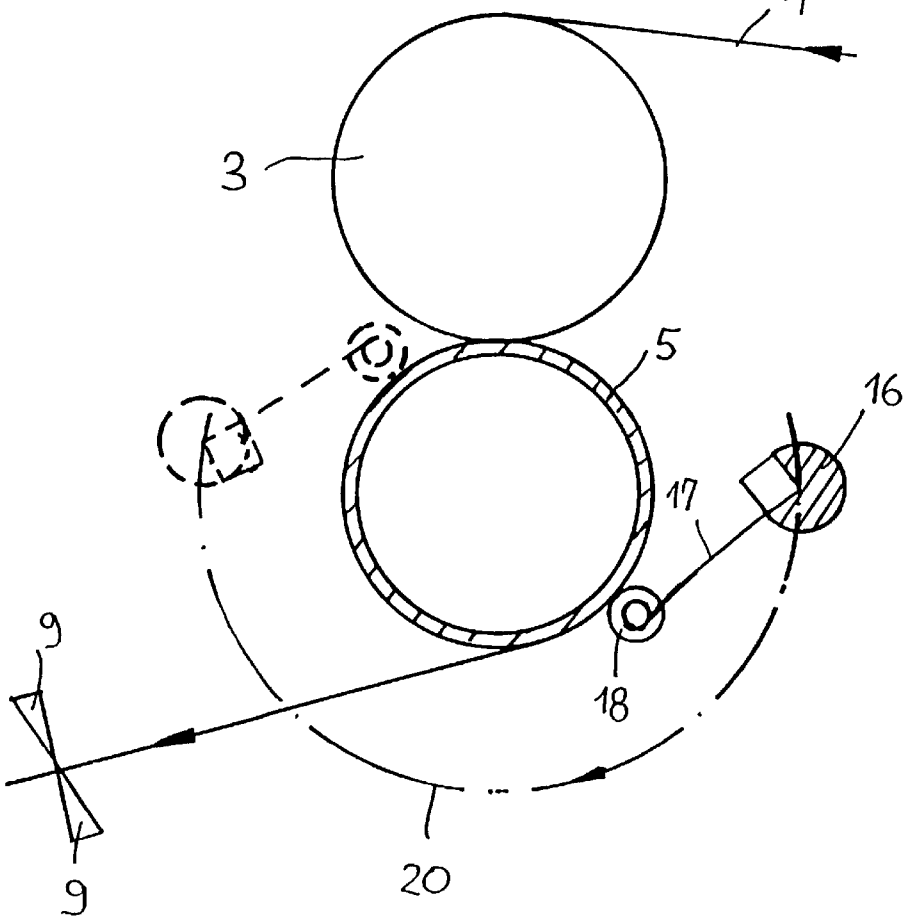
FIG. 9 is a schematic enlarged illustration of the start of the applying method.

As shown in FIG. 4 now the support levers 8 of the transverse-cutting system 7 are moved together like tongs so that the blades 9 they carry cut through the web. The spacing between the pressure rollers 18 and the cutting blades 9 corresponds generally to the remaining circumference from the leading contact place of the pressure rollers 18 on the winding sleeve to the contact point between the contact roller 3 and the winding sleeve 5. After cutting through the web the above-described pivoting mechanism 14 and the lever 22 of the connecting rod are moved via the rotatable ring disks 19 on a concentric circle 20 as shown in FIG. 9 until the pressure rollers 18 stop shortly before reaching the contact point between the contact roller 3 and the winding sleeve 5. This pivoting of the connecting rod 16 and of the pressure element lays the leading end of the web perfectly and without folds as well as without the use of an adhesive around the winding sleeve 5. The end position of the connecting rod 16 and the pressure rollers 18 fixed thereon is shown in solid lines in FIG. 10. After winding several turns of the web the ring disks 19 are turned by the pivoting mechanism 14 such that the pivoting mechanism moves free of the winding shaft so that then the arms 12 of the applicator mechanism can be returned to the starting positions shown in FIGS. 1 and 6. The same is also true for the transverse-cutting system 7.

We claim:

1. An apparatus for winding a web on a sleeve, the apparatus comprising:

at least one winding shaft adapted to hold the sleeve and pivotal into a winding position coaxial with a winding axis and into a takeoff position spaced therefrom;

means including a contact roller around which the web passes for pressing the web radially toward the winding axis, whereby when a sleeve is in the winding position the contact roller presses the web against it;

cutting means for severing the web when same extends from the contact roller to the takeoff position between the contact roller and the takeoff position and thereby producing a leading web end extending from between the contact roller and a sleeve in the winding position; and applying means including a connecting rod pivotal about the winding axis and extending a full working width of the machine, pressure elements extending from the connecting rod and having free ends, and respective rollers on the free ends engageable with the web for pressing the leading end against the sleeve in the winding position after severing of the web.

2. The web-winding apparatus defined in claim 1, further comprising means for pivoting the connecting rod about the winding axis.

3. The web-winding apparatus defined in claim 2 wherein the pivoting means includes a first slotted ring, a lever extending from the connecting rod, centered on the winding axis, and carrying the first ring, and a second slotted ring coaxial with and rotatable relative to the first ring.

4. The web-winding apparatus defined in claim 3 wherein the means for pivoting only pivots the rollers through an arc that ends immediately short of a location where the contact roller engages the sleeve in the winding position.

5. The web-winding apparatus defined in claim 3 wherein the pivoting means further includes a pair of drive gears meshing with the second slotted ring and spaced angularly apart by a distance greater than an angular width of a slot of the second ring.

6. The web-winding apparatus defined in claim 3 wherein the cutting means includes a pair of arms pivotal about a cutter axis offset from the winding axis and having ends carrying blades interengageable to cut the web, the pivoting means further including an arm pivotal about the cutter axis and carrying the first disk.

* * * * *